US010677414B2

(12) United States Patent
Duval et al.

(10) Patent No.: US 10,677,414 B2
(45) Date of Patent: Jun. 9, 2020

(54) LIGHT EMISSION MODULE FOR MOTOR VEHICLE

(71) Applicant: VALEO VISION, Bobigny (FR)

(72) Inventors: Christophe Duval, Bobigny (FR); Stephan Sommerschuh, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 15/855,022

(22) Filed: Dec. 27, 2017

(65) Prior Publication Data

US 2018/0187859 A1 Jul. 5, 2018

(30) Foreign Application Priority Data

Jan. 4, 2017 (FR) ..... 17 50061

(51) Int. Cl.

| | |
|---|---|
| ***F21S 45/43*** | (2018.01) |
| ***F21S 43/31*** | (2018.01) |
| ***F21V 14/04*** | (2006.01) |
| ***F21S 45/48*** | (2018.01) |
| ***F21V 29/83*** | (2015.01) |
| ***F21V 29/76*** | (2015.01) |
| ***F21S 43/20*** | (2018.01) |
| ***F21V 29/67*** | (2015.01) |
| ***F21V 29/505*** | (2015.01) |
| ***F21S 41/675*** | (2018.01) |
| *F21S 43/14* | (2018.01) |

(Continued)

(52) U.S. Cl.

CPC ..... *F21S 45/43* (2018.01); *F21S 41/675* (2018.01); *F21S 43/26* (2018.01); *F21S 43/31* (2018.01); *F21S 45/48* (2018.01); *F21V 14/04* (2013.01); *F21V 29/505* (2015.01); *F21V 29/673* (2015.01); *F21V 29/677* (2015.01); *F21V 29/76* (2015.01); *F21V 29/83* (2015.01); *F21S 43/14* (2018.01); *F21S 43/50* (2018.01); *F21Y 2115/10* (2016.08)

(58) Field of Classification Search

CPC .. F21S 45/43; F21S 43/31; F21S 43/26; F21S 45/48; F21S 43/14; F21V 29/677; F21V 29/76; F21V 29/83; F21V 14/04; F21Y 2115/10

USPC ..... 362/512

See application file for complete search history.

(56) References Cited

U.S. PATENT DOCUMENTS 6,386,744 B1 * 5/2002 Scholl ..... F21V 11/12 362/518

6,508,556 B1 1/2003 Ueda (Continued)

OTHER PUBLICATIONS

French Preliminary Search Report dated May 18, 2017 in French Application 17 50061, filed on Jan. 4, 2017 (with English Translation of Categories of Cited Documents).

*Primary Examiner* — Anh T Mai
*Assistant Examiner* — Jessica M Apenteng
(74) *Attorney, Agent, or Firm* — Oblon, McClelland, Maier & Neustadt, L.L.P.

(57) ABSTRACT

Light emission module, comprising a housing having at least one first opening and a second opening, a shaping optic, a light emission source, a module with mirrors disposed to receive at least a part of the light rays emitted by the light emission source, and a plurality of mirrors. The light emission module furthermore includes a cooling module configured to generate a flow of fluid circulating inside the inner space between the first and second openings in order to cool the light emission module.

23 Claims, 2 Drawing Sheets

(51) Int. Cl.
*F21Y 115/10* (2016.01)
*F21S 43/50* (2018.01)

(56) References Cited

U.S. PATENT DOCUMENTS

| | | | | |
|---|---|---|---|---|
| 8,708,536 | B1 * | 4/2014 | Mathieu | B60Q 1/2665 362/487 |
| 2009/0303742 | A1 * | 12/2009 | Yasuda | F21V 29/71 362/547 |
| 2013/0258689 | A1 | 10/2013 | Takahira et al. | |
| 2014/0340653 | A1 | 11/2014 | Chifu et al. | |
| 2016/0290589 | A1 * | 10/2016 | Redjem-Saad | F21S 41/147 |
| 2017/0160542 | A1 * | 6/2017 | Mouri | F21V 29/503 |

* cited by examiner

LIGHT EMISSION MODULE FOR MOTOR VEHICLE

BACKGROUND OF THE INVENTION

1. Field of the Invention

The field of the invention relates to the light emission devices that motor vehicles comprise and to the light emission modules that these devices comprise.

2. Description of the Related Art

Some of these modules comprise a light emission source that is coupled to a module with mirrors comprising a plurality of micromirrors selectively controllable for moving them between a position in which they contribute to a light beam output from the device, and another position in which they do not contribute to it.

When functioning, this type of module produces, in addition to light, heat that tends to accumulate inside the light emission device.

Now, this heat thermally stresses the elements of the device as well as the surrounding elements, and leads to the premature deterioration of the light emission device in a general manner.

In order to limit these problems, it is commonly envisaged to provide the emission modules with heat dissipaters, comprising for example cooling fins coupled to a given element.

However, this approach is not entirely satisfactory, and the heat produced by using a light emission source in the light emission devices remains a significant problem.

SUMMARY OF THE INVENTION

The invention aims to improve this situation.

For this purpose, the invention relates to a light emission module, in particular for motor vehicle, the light emission module including:

- a housing delimiting an inner space and comprising at least one first opening and a second opening,
- a shaping optic tailored to shape light rays in order to form an output beam from the light emission module,
- a light emission source tailored to emit light rays in the inner space,
- a module with mirrors disposed to receive at least a part of the light rays emitted by the light emission source, the module with mirrors comprising a plurality of mirrors, each one moveable between a first position in which the corresponding mirror is disposed to reflect light rays reaching it from the light emission source towards the shaping optic, and a second position in which the corresponding mirror is disposed to reflect the light rays reaching it from the light emission source away from the shaping optic, the light emission module furthermore comprising a cooling module configured to generate a flow of fluid circulating inside the inner space between the first and second openings in order to cool the light emission module.

According to an aspect of the invention, at least a part of the mirrors are, in second position, disposed to reflect the light rays reaching them from the light emission source towards at least one wall of the housing, the second opening being formed in the wall.

According to an aspect of the invention, the light emission module comprises at least one masking element disposed on an optical route between the module with mirrors and the second opening, the masking element being configured to prevent light rays coming from the mirrors and following the optical route from exiting the housing through the second opening.

According to an aspect of the invention, the masking element extends from the wall.

According to an aspect of the invention, the flow of fluid circulates in contact with the masking element.

According to an aspect of the invention, the light emission module comprises at least two masking elements extending from the wall, the two masking elements delimiting between them a channel for circulating fluid exiting outside the housing through the second opening.

According to an aspect of the invention, the second opening forms a fluid flow outlet opening from the housing.

According to an aspect of the invention, the housing comprises a plurality of second openings, the cooling module being configured to generate a plurality of flows of fluid, each circulating between the first opening and one of the second openings.

According to an aspect of the invention, the light emission source comprises a heat dissipater disposed through the housing or disposed outside the housing, the cooling module being furthermore configured to generate a second flow of fluid circulating in contact with the heat dissipater.

According to an aspect of the invention, the cooling module comprises a fan.

According to an aspect of the invention, the fan is configured to generate simultaneously the flow of fluid circulating in the inner space of the housing and the second flow of fluid circulating in contact with the heat dissipater.

According to an aspect of the invention, an outlet of fluid from the fan is disposed opposite the first opening.

According to an aspect of the invention, the cooling module comprises a circulating conduit fluidly connecting an outlet of fluid from the fan to the first opening.

According to an aspect of the invention, the fan is an axial fan.

According to an aspect of the invention, the fan is a centrifugal fan.

The invention furthermore relates to a light emission device, in particular for motor vehicle, comprising a light emission module as defined above.

According to an aspect of the invention, the light emission device is a motor vehicle lighting and/or signalling device.

According to an aspect of the invention, the light emission device is configured to implement one or more photometric functions, regulated functions in particular.

BRIEF DESCRIPTION OF THE DRAWINGS

The invention will be better understood on reading the detailed description that will follow, given solely as an example and made with reference to the attached figures, of which.

DETAILED DESCRIPTION OF THE INVENTION

Figure 1:
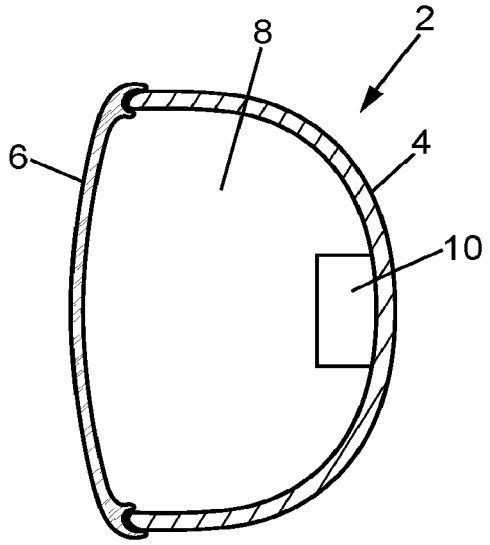
FIG. 1 is a diagrammatic illustration of a light emission device according to the invention.

FIG. 1 illustrates a light emission device 2 according to the invention, hereinafter device 2, configured to emit light.

The device 2 is advantageously a device intended to be installed in a motor vehicle. In other words, it is a motor vehicle device.

Advantageously, the device 2 is a motor vehicle lighting and/or signalling device.

It is configured for example to implement one or more photometric functions.

A photometric function is for example a lighting and/or signalling function visible to a human eye. It is noted that these photometric functions can be the object of one or more regulations defining requirements for colorimetry, intensity, spatial distribution according to a grid called photometric, or visibility ranges of the emitted light.

The device 2 is for example a lighting device and then constitutes a projector—or front headlamp—of a vehicle. It is then configured to implement one or more photometric functions chosen for example from a low beam function (UNECE Regulations 87 and 123), a position light function (UNECE Regulation 007), a high beam function (UNECE Regulation 123), a fog beam function (UNECE Regulations 019 and 038).

Alternatively or in parallel, the device is a signalling device intended to be disposed at the front or at the rear of the vehicle.

When it is intended to be disposed at the front, these photometric functions include a function for indicating a change of direction (UNECE Regulation 006), a Daytime Running Light function, acronym DRL (UNECE Regulation 087), a front lighting signature function.

When it is intended to be disposed at the rear, these photometric functions include a function for indicating reversing (UNECE Regulation 023), a stop function (UNECE Regulation 007), a fog beam function (UNECE Regulations 019 and 038), a function for indicating a change of direction (UNECE Regulation 006), a rear lighting signature function.

Alternatively, the device 2 is provided for lighting the interior of a vehicle and is then intended to emit light mainly in the interior of the vehicle.

In what follows, the device 2 is described in a non-limitative manner in a configuration in which it is intended to emit light outside the vehicle.

With reference to FIG. 1, the device 2 comprises a casing 4 and a closure glass 6, cooperating with each other to delimit a cavity 8 internally.

The device 2 furthermore comprises a light emission module 10 according to the invention, hereinafter module 10, disposed wholly or partly in the cavity 8.

Figure 2:
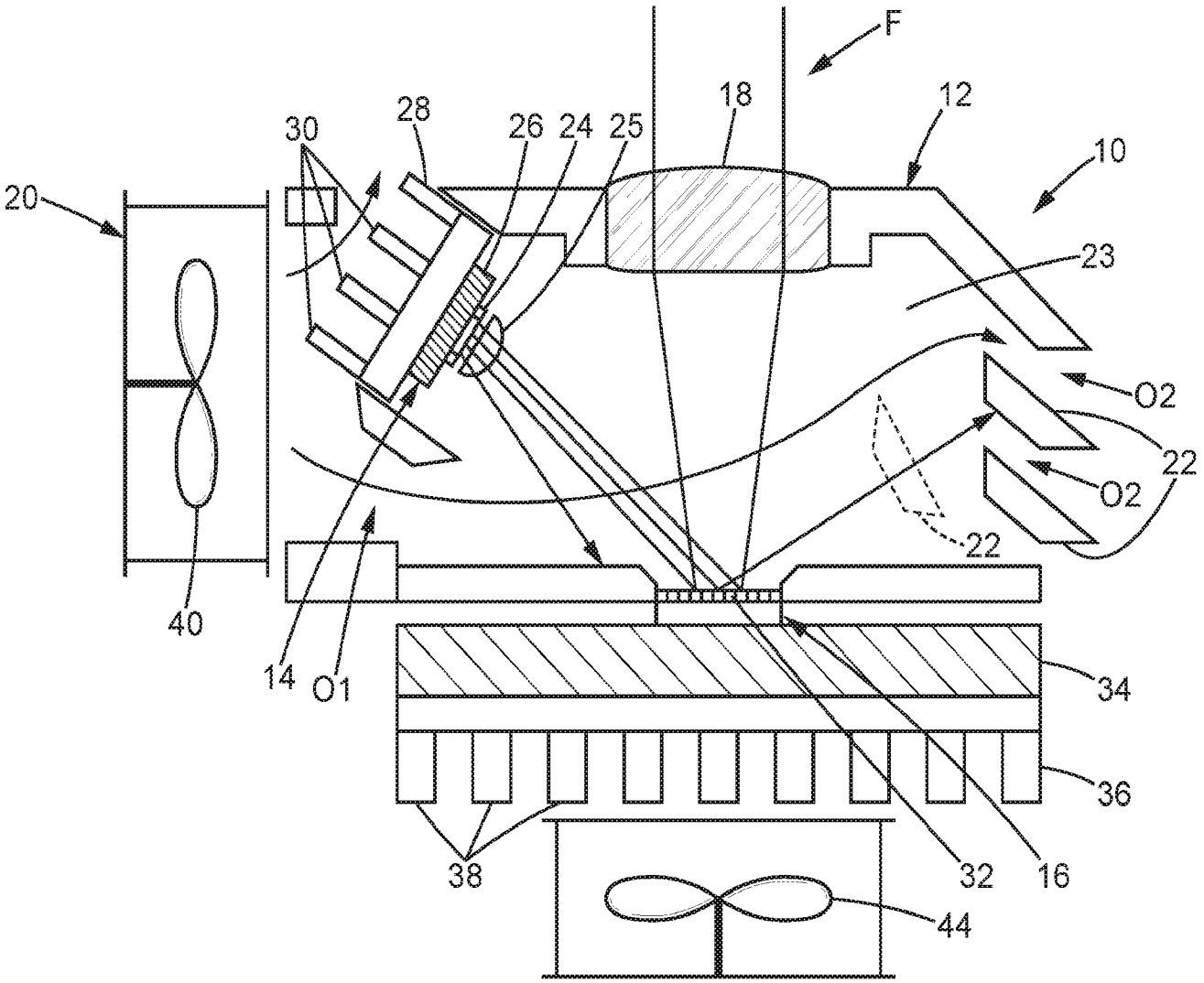
FIG. 2 illustrates a light emission module according to the invention.

With reference to FIG. 2, the module 10 is configured to generate a light beam F. For example, in the example of FIG. 1, it is disposed to emit this light beam towards the closure glass (which is transparent for at least a part of the light beam F).

The light emission module 10 comprises a housing 12, a light emission source 14, a module with mirrors 16, a shaping optic 18 and a cooling module 20. Advantageously, the light emission module 10 furthermore comprises at least one masking element 22.

The housing 12 is configured to accommodate at least a part of the elements of the module.

The housing 12 is advantageously rigid. It has for example a general shape of a parallelepiped. However, alternatively, it has any shape.

It is made for example from opaque polycarbonate (acronym PC). Alternatively, the housing 12 is made for example from aluminium.

The housing 12 comprises walls that jointly delimit an inner space 23 of the housing.

The housing 12 furthermore comprises at least one first opening O1 and a second opening O2. These openings are arranged in one or more walls of the housing. The openings are advantageously arranged in different walls.

The first and the second openings O1, O2 form an inlet opening of a flow of fluid intended to circulate in the inner space and described below, respectively an outlet opening of the flow of fluid.

For example, the first opening is arranged in a side wall of the housing. Furthermore, the second opening is arranged for example in another side wall of the housing. For example, these side walls are opposite each other.

It is noted that as a variant, the openings O1, O2 are arranged in the same wall.

In certain embodiments, the housing 12 comprises more than one first opening O1, and/or more than one second opening. In the example of FIG. 2, the housing comprises one opening O1 and a plurality of openings O2.

The light emission source 14, hereinafter source 14, forms the light emission core of the module 10. In other words, it is tailored to emit light rays inside the light emission module.

The light emission source 14 comprises a light-emitting element 24 tailored to emit light rays, an optic 25 and a substrate 26 on which the light-emitting element is disposed.

The light-emitting element 24 is for example a light-emitting diode configured to generate light rays when it is powered with electrical energy. For example, the light-emitting element 24 is configured to generate white-coloured light rays.

The optic 25 is configured to shape at least a part of the light rays coming from the light-emitting element 24. Here, the optic 25 is more specifically configured to shape the light rays emitted by the light-emitting element 24 so that the major part of these rays reaches the module with mirrors 16. Advantageously, substantially the totality of the light rays shaped by the optic 25 reaches the module with mirrors.

For example, the shaping optic 25 comprises or is formed by a lens.

The shaping optic 25 is disposed opposite the light-emitting element 24. For example, it is fixed relative to the light emission source 14.

The substrate 26 forms a support for the light-emitting element. Furthermore, it is configured to power the light-emitting element 24 with electrical energy for the latter to generate light rays. The substrate 26 comprises or is presented in the form of a printed circuit board, acronym PCB.

Optionally, the source 14 furthermore comprises a heat dissipater 28 thermally coupled to the substrate 26 and configured to dissipate heat generated by the source 14 when it is functioning.

For example, the heat dissipater 28 comprises a plurality of cooling fins 30 extending from a base of the dissipater mounted on a rear face of the substrate 26.

It is noted that the source can comprise a control module (not illustrated) tailored to control the substrate and the light-emitting element for lighting and extinguishing the latter.

The source 14 is disposed wholly or partly in an accommodating orifice arranged in a wall of the housing 12. In other words, the source 14 is wholly or partly fixed through a wall of the housing 12. Alternatively or in parallel, it is disposed opposite this orifice. Here, "opposite" means that at least a part of the source is visible through the orifice in a viewing direction facing the orifice. In the example of FIG.

2, the source 14 is disposed opposite this orifice, the dissipater being partly accommodated through the orifice.

Furthermore, the light emission source 14 is disposed to emit at least a part of its light rays towards the module with mirrors 16. Advantageously, it is disposed so that the major part of the rays it emits reaches the module with mirrors 16. In practice, the source 14 has a privileged emission direction oriented towards the module with mirrors 16.

The shaping optic 18 is configured to divert at least a part of the light rays coming from the source 14 in order to form the beam F of the light emission module 10. As described below, the rays reaching it come mainly from a reflection operated by the module with mirrors 16.

"Divert" means that the direction of propagation of the light ray entering the shaping optic 18 is different from the direction of the light ray exiting the shaping optic 18.

For example, the shaping optic 18 comprises or is formed by a lens. This lens is for example a converging lens. It is configured for example to collimate the light rays passing through it.

The shaping optic 18 is for example accommodated through a wall of the housing 12. In other words, it is fixed to the housing 12 inside an accommodating orifice provided for this purpose and arranged in a wall. The wall in question is for example an upper wall of the housing 12 (in the direction of orientation of FIG. 2). This wall for example faces the closure glass 6 of the device 2.

The module with mirrors 16 is configured to receive at least a part of the rays generated by the source 14, and to return at least a part to the optic 18.

More specifically, the module with mirrors 16 is configured to authorise the selective lighting and extinction of different regions of the output beam F generated by the module 10. In other words, the module with mirrors 16 is configured so that the output beam from the module 10 is a pixelated beam whose different regions can be controlled for lighting and extinction via the module with mirrors 16.

Such a module is known for example by the acronym DMD for Digital Micromirror Device.

The module with mirrors 16 comprises a plurality of mirrors 32 and a substrate 34.

Each mirror 32 is selectively moveable. In other words, each mirror is moveable independently of the other mirrors. Furthermore, each mirror is tailored to move between at least two positions:

- a first position in which the mirror is disposed to reflect the light rays reaching it from the light emission source 14 towards the shaping optic 18,
- a second position in which the mirror is disposed to reflect the light rays reaching it from the light emission source 14 away from the shaping optic 18.

In practice, in the first position, the mirrors are each oriented so that the light rays reaching them from the source 14 are reflected towards the shaping optic 18 and contribute to the output beam. Furthermore, in the second position, the mirrors are oriented so that the light rays reaching them are reflected in a direction in which they do not contribute to the output beam.

For example, the mirrors are configured, in second position, to send the light rays reflected by them towards a wall of the housing 12. For example, they are configured so that they all send the light rays to the same wall. Alternatively, they are configured to send the light rays to a region of the housing delimited by a plurality of walls. It is noted that the or at least one of the second openings is advantageously arranged in a wall to which the mirrors return the light rays when in second position.

The module with mirrors 16 comprises a control module (not illustrated) tailored to control the movement of each of the mirrors in a selective manner. This module is for example mounted on the substrate 34. It is located for example next to the mirrors 32.

The substrate 34 forms a support for the mirrors. The substrate is presented for example in the form of a flat plate. It possesses for example metallized tracks for routing electrical energy to the mirrors in order to set them in motion.

The mirrors are disposed to protrude relative to the face of the substrate on which they are mounted. The mirrors are for example disposed on the substrate 34 in such a way as to form one or more regions of mirrors. For example, they are arranged on the substrate within each region according to a matrix arrangement. Such regions are known for example by the name "DMD chips".

Advantageously, the substrate of the module with mirrors 16 is situated outside the housing. It is disposed for example opposite a wall of the housing 12, or in contact with it. This wall advantageously faces the shaping optic 18. In the example of FIG. 2, it is a lower wall of the housing 12 (in the direction of orientation of FIG. 2).

The wall in question comprises an orifice for accommodating and/or passing the mirrors 32. This orifice is for example disposed opposite the optic 18, with the mirrors facing the optic. For example, as illustrated in FIG. 2, the mirrors 32 are accommodated in the orifice in question.

The module 16 is preferably fixed relative to the housing so that the relative positions of the mirrors and the optic 18 do not change overtime. Advantageously, the distance between the mirrors 32 and the shaping optic 18 is comprised between 8 mm and 50 mm.

Optionally, the module with mirrors 16 comprises a heat dissipater 36 tailored to dissipate the heat generated at the module with mirrors 16 when the device 2 functions.

For example, the heat dissipater 36 comprises a plurality of cooling fins 38 extending from a base fixed to a rear face of the substrate 34. These fins extend for example on the other side of the wall of the housing 12 to which the module with mirrors 16 is coupled.

The cooling module 20 is configured to cool the light emission module 10.

More specifically, the cooling module 20 is tailored in the context of the invention to cool the light emission module 10 by generating at least one flow of fluid circulating inside the inner space delimited by the housing 12. Even more specifically, this flow of fluid is configured to circulate in the inner space between the first and the second openings O1, O2.

In practice, depending on their number, the openings O1, O2 define one or a plurality of fluid circulation routes inside the inner space of the housing. The cooling module is therefore configured to generate one or a plurality of flows of fluid inside this inner space. In the example of FIG. 2, the module 20 therefore generates a flow of fluid between the opening O1 and an opening O2, and another flow of fluid between the opening O1 and the other opening O2.

The fluid set in motion by the cooling module 20 is preferably a gas. Advantageously, it is air.

The cooling module 20 comprises at least one fan 40. The fan 40 is configured to generate, when functioning, a flow of fluid at a fluid outlet that it possesses.

For example, the fan 40 is an axial fan. These fans are also known by the name helical fans. In other words, the fan comprises a propeller and blades, which, by rotating around an axis, set in motion the fluid on contact with them along a local direction extending substantially parallel to the axis of rotation of the propeller.

However, alternatively, the fan 40 is a centrifugal fan. This type of fan comprises an admission of fluid, and an outlet opening through which the fluid is expelled substantially perpendicular to the axis of rotation of a mobile element of the fan. It is noted that the centrifugal fans here include the tangential fans, in which the admission of fluid is also perpendicular to the fan outlet.

Advantageously, the fan is disposed opposite the first opening O1. In other words, the fluid outlet that the fan comprises is disposed opposite the first opening. For this purpose, the fan is fixed for example to the housing 12 in the vicinity of this opening.

However, alternatively, the fan 40 is not disposed opposite the first opening O1. For example it is then offset from the housing 12. Advantageously, in this configuration, the cooling module 20 furthermore comprises a fluid circulation conduit fluidly connecting the fan 40 and the first opening O1. This conduit is configured to convey the fluid set in motion by the fan 40 to the first opening O1.

In the context of the invention, advantageously, the cooling module 20 is furthermore configured to generate a second flow of fluid tailored to circulate in contact with the light emission source 14. More specifically, it is configured so that the second flow of fluid circulates in contact with its heat dissipater 28.

Several embodiments can then be envisaged.

In an embodiment illustrated in FIG. 2, the flow of fluid circulating between the first and second openings and the second flow of fluid are generated by the same fan 40 of the cooling module 20. For example, the output of fluid from the fan 40 has a portion opposite the first opening, and a portion opposite the dissipater 28 of the source 14.

Alternatively, the cooling module 20 comprises at least one first fan for generating the flow of fluid circulating inside the inner space, and at least one second fan distinct from the first fan for generating the second flow of fluid for cooling the source 14.

Optionally and as shown on FIG. 2, the cooling module 20 comprises a fan 44 disposed opposite the heat dissipater 36 of the module with mirrors 16. The fan 44 is configured to make a fluid circulate in contact with this heat dissipater in order to improve the evacuation of heat from the module with mirrors.

The masking element 22 is configured to prevent the light rays coming from the mirrors from exiting the housing 12 through at least one second opening O2.

More specifically, the masking element 22 is tailored to prevent light rays reflected by the mirrors, these rays being located in second position and following an optical route between the module with mirrors 16 and the second opening O2, from exiting through the opening or openings O2.

The masking element 22 is presented for example in the form of a blade of material. This blade has any shape. For example, it is flat. Alternatively, it is curved.

In a general manner, the masking element 22 has a surface opaque to the light generated by the source 14. This surface is disposed on the optical route between the module with mirrors 16 and the second opening, this surface intersecting the optical route in question so that the light rays do not reach the second opening O2.

Several configurations can be envisaged for the masking element 22.

In the configuration of FIG. 2, the masking element 22 extends from the wall in which the second opening or one of the second openings O2 is made. It then forms for example a lip extending from the wall. It then extends into the inner space 23 and/or outside the housing.

In an alternative configuration (illustrated by dots on FIG. 2), the masking element 22 is situated away from the wall in which the second opening or one of the second openings O2 is arranged.

For example, it extends inside the inner space. It extends for example from one wall of the housing 12 to another, which do not support an opening O2, where it is fixed by its ends.

Advantageously, and as illustrated on FIG. 2, the module comprises at least two masking elements.

For example, they both extend from a wall of the housing. The two masking elements delimit between them a channel for circulating fluid exiting outside the housing 12 through the second opening or a second opening O2.

Whatever the envisaged configuration, advantageously at least one flow of fluid generated by the cooling module 20 and circulating in the inner space of the housing 12 circulates in contact with at least one masking element 22.

The functioning of the light emission module 10 according to the invention will now be described with reference to the figures, FIG. 2 in particular.

The emission, by the light emission source 14, of light rays inside the inner space delimited by the housing 12 of the light emission module 10 results in the light emission device 2 starting to function.

At least a part of these light rays is sent towards the module with mirrors 16, whose mirrors reflect these light rays towards the shaping optic or away from it depending on the position they are in at the corresponding moment.

The position of each mirror is for example modified over time depending on the beam F desired at a given moment.

The light rays reflected by the module with mirrors 16 away from the shaping optic 18 cause an accumulation of heat inside the module 10, in particular the zone of the housing to which the mirrors reflect the light in second position. Furthermore, the rays emitted by the source towards the walls around the module with mirrors 16 also contribute to this heat.

In parallel, the cooling module 20 generates the flow or flows of fluid, which penetrate(s) the housing through the first opening O1 and circulate(s) in the inner space of the housing, potentially passing in contact with the masking element or elements 22. This flow or these flows exit through the second opening or openings.

Furthermore, the second flow of fluid circulates in contact with the source 14.

Again in parallel, the masking element or elements 22 prevent(s) the light rays reflected by the mirrors arranged in second position from exiting through the opening or openings O2.

The invention has several advantages.

First of all, the presence of the cooling module makes it possible substantially to lower the temperature of the device 2 in a general manner when it is functioning.

This effect is even more evident when the cooling module generates, in addition to the flow of fluid, the second flow of fluid directed towards the source 14.

The heat that tends to accumulate in the housing, in particular in the vicinity of the module with mirrors due to the imperfect directivity of the light source to the module 16 and in the region of the housing to which the mirrors reflect the light in second position, is therefore advantageously dissipated.

On the other hand, the use of masking elements is particularly advantageous in the configurations in which the flows of fluid circulate in the region of the housing strongly heated by the mirrors that reflect the light away from the shaping optic. In effect, the presence of the second opening or openings does not then result in these light rays exiting through these openings made in the housing. It is therefore not necessary to add to the module 10 specific external equipment aiming to obtain an optical output equivalent to those of the current devices.

The light emission module according to the invention therefore contributes to attenuating significantly the heat that stresses the different elements of the light emission device while not degrading the light output obtained.

In the above description, the source, the module with mirrors and the shaping optic have been described as accommodated in an orifice of a wall of the housing. According to a variant of the invention, the light emission source 14, the optic 18 and/or the module with mirrors 16 are opposite the orifice but are not disposed directly in the orifice.

It is noted that the invention furthermore relates to a light emission module, in particular for motor vehicle, including:

a housing delimiting an inner space, a shaping optic tailored to shape light rays in order to form an output beam from the light emission module, a light emission source tailored to emit light rays in the inner space, a heat dissipater disposed to dissipate at least a part of the heat generated by the light emission source of light rays, a module of mirrors disposed to receive at least a part of the light rays emitted by the light emission source, the module with mirrors comprising a plurality of mirrors, each moveable between a first position in which the corresponding mirror is disposed to reflect the light rays reaching it from the light emission source towards the shaping optic, and a second position in which the corresponding mirror is disposed to reflect the light rays reaching it from the light emission source away from the shaping optic, the light emission module furthermore comprising a cooling module configured to generate a flow of fluid circulating in contact with the heat dissipater of the light emission source in order to cool the light emission source.

The invention claimed is:

1. Light emission module including:

a housing delimiting an inner space and comprising at least one first opening and a second opening, a shaping optic tailored to shape light rays in order to form an output beam from the light emission module, a light emission source tailored to emit light rays in the inner space, a module with mirrors disposed to receive at least a part of the light rays emitted by the light emission source, the module with mirrors comprising a plurality of mirrors, each one moveable between a first position in which the corresponding mirror is disposed to reflect light rays reaching it from the light emission source towards the shaping optic, and a second position in which the corresponding mirror is disposed to reflect the light rays reaching it from the light emission source away from the shaping optic, at least one masking element disposed between the module with mirrors and the housing and configured to prevent light rays reflected from the mirrors from exiting the housing through the second opening, a cooling module configured to generate a flow of fluid circulating inside the inner space between the first and second openings in order to cool the light emission module, wherein the at least one masking element and the housing together define an exit passage at the second opening for the flow of fluid.

2. The light emission module, according to claim 1, characterized in that at least a part of the mirrors is, in the second position, disposed to reflect the light rays reaching them from the light emission source towards at least one wall of the housing, the second opening being formed in the wall.

3. The light emission module, according to claim 2, wherein the at least one masking element is disposed on an optical route between the module with mirrors and the second opening, the masking element being configured to prevent light rays coming from the mirrors and following said optical route from exiting the housing through the second opening.

4. The light emission module according to claim 3, wherein the flow of fluid circulates in contact with the masking element.

5. The light emission module, according to claim 2, wherein the light emission module comprises at least two masking elements extending from said wall, two masking elements delimiting between them a channel for circulating fluid exiting outside the housing through the second opening.

6. The light emission module, according to claim 2, wherein the masking element extends from said wall.

7. The light emission module, according to claim 2, wherein the light emission module comprises at least two masking elements extending from said wall, the two masking elements delimiting between them the passage for the fluid exiting outside the housing through the second opening.

8. The light emission module, according to claim 1, wherein the second opening forms a fluid flow outlet opening from the housing.

9. The light emission module, according to claim 1, wherein the housing comprises a plurality of second openings, the cooling module being configured to generate a plurality of flows of fluid, each circulating between the first opening and one of the second openings.

10. The light emission module, according to claim 1, wherein the light emission source comprises a heat dissipater disposed through the housing or disposed outside the housing, the cooling module being furthermore configured to generate a second flow of fluid circulating in contact with the heat dissipater.

11. The light emission module according to claim 10, wherein the fan is configured to generate simultaneously the flow of fluid circulating in the inner space of the housing and the second flow of fluid circulating in contact with the heat dissipater.

12. The light emission module, according to claim 1, wherein the cooling module comprises a fan.

13. The light emission module, according to claim 12, wherein an outlet of fluid from the fan is disposed opposite the first opening.

14. The light emission module, according to claim 12, wherein the cooling module comprises a circulating conduit fluidly connecting an outlet of fluid from the fan to the first opening.

15. The light emission module, according to claim 12, wherein the fan is an axial fan.

16. The light emission module, according to claim 12, wherein the fan is a centrifugal fan.

17. The light emission device, wherein the device comprises a light emission module according to claim 1.

18. The light emission device, according to claim 17, wherein the device is a one of a motor vehicle lighting and a motor vehicle signaling device.

19. The light emission device, according to claim 17, wherein the light emission device is configured to implement one or more photometric functions.

20. The light emission module according to claim 1, wherein the flow of fluid circulates in contact with the masking element.

21. The light emission module, according to claim 1, wherein the light emission source comprises a heat dissipater disposed through the housing or disposed outside the housing proximate to the first opening, and the cooling module is configured to generate a second flow of fluid circulating in contact with the heat dissipater.

22. The light emission module, according to claim 1, comprising:

a second masking element disposed between the light emission source and the housing proximate to the first opening and configured to prevent light rays from the light source exiting through the first opening.

23. The light emission module, according to claim 22, wherein the second masking element and the housing together define an entrance passage at the first opening for the flow of fluid.

* * * * *